US008700370B2

(12) United States Patent
Landa

(10) Patent No.: US 8,700,370 B2
(45) Date of Patent: Apr. 15, 2014

(54) METHOD, SYSTEM AND PROGRAM STORAGE DEVICE FOR HISTORY MATCHING AND FORECASTING OF HYDROCARBON-BEARING RESERVOIRS UTILIZING PROXIES FOR LIKELIHOOD FUNCTIONS

(75) Inventor: Jorge L. Landa, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1312 days.

(21) Appl. No.: 11/960,288

(22) Filed: Dec. 19, 2007

(65) Prior Publication Data

US 2008/0162100 A1 Jul. 3, 2008

Related U.S. Application Data

(60) Provisional application No. 60/882,471, filed on Dec. 28, 2006.

(51) Int. Cl.

| | |
|---|---|
| ***G06G 7/48*** | (2006.01) |
| ***G06F 7/60*** | (2006.01) |
| ***G06F 17/10*** | (2006.01) |
| ***G01V 1/40*** | (2006.01) |
| ***G06F 17/18*** | (2006.01) |
| ***G06F 19/00*** | (2011.01) |
| ***G10L 15/00*** | (2013.01) |
| ***G10L 15/06*** | (2013.01) |
| ***G10L 15/04*** | (2013.01) |

(52) U.S. Cl.

USPC ..... 703/10; 703/2; 702/13; 702/181; 704/244; 704/254

(58) Field of Classification Search

USPC ..... 703/10, 2; 702/13, 181; 704/244, 254

See application file for complete search history.

(56) References Cited

U.S. PATENT DOCUMENTS

| | | | | |
|---|---|---|---|---|
| 5,764,515 | A * | 6/1998 | Guerillot et al. | 702/2 |
| 5,838,634 | A * | 11/1998 | Jones et al. | 367/73 |
| 6,101,447 | A * | 8/2000 | Poe, Jr. | 702/13 |
| 6,549,854 | B1 * | 4/2003 | Malinverno et al. | 702/16 |
| 6,549,879 | B1 * | 4/2003 | Cullick et al. | 703/10 |

(Continued)

OTHER PUBLICATIONS

J. L. Landa, R. K.Kalia, A.Nakano, K. Nomura, and P. Vashishta , "History Match and Associated Forecast Uncertainty Analysis—Practical Approaches Using Cluster computing", IPTC, Nov. 2005.*

(Continued)

*Primary Examiner* — Omar Fernandez Rivas
*Assistant Examiner* — Angel Calle
(74) *Attorney, Agent, or Firm* — Tiffany E. Weksberg

(57) ABSTRACT

A method, system and program storage device for history matching and forecasting of subterranean reservoirs is provided. Reservoir parameters and probability models associated with a reservoir model are defined. A likelihood function associated with observed data is also defined. A usable likelihood proxy for the likelihood function is constructed. Reservoir model parameters are sampled utilizing the usable proxy for the likelihood function and utilizing the probability models to determine a set of retained models. Forecasts are estimated for the retained models using a forecast proxy. Finally, computations are made on the parameters and forecasts associated with the retained models to obtain at least one of probability density functions, cumulative density functions and histograms for the reservoir model parameters and forecasts. The system carries out the above method and the program storage device carries instructions for carrying out the method.

22 Claims, 5 Drawing Sheets

(56) References Cited

U.S. PATENT DOCUMENTS

| | | | | |
|---|---|---|---|---|
| 7,149,671 | B2 * | 12/2006 | Lim et al. | 703/9 |
| 2003/0225606 | A1 * | 12/2003 | Raghuraman et al. | 705/7 |
| 2004/0230379 | A1 * | 11/2004 | Houck | 702/14 |
| 2009/0125288 | A1 * | 5/2009 | Main et al. | 703/10 |

OTHER PUBLICATIONS

J. L. Landa, R. K. Kalia, A. Nakamo, L. Nomura, and P. Vashishta, "History Match and Associated Forecast Uncertainty Analysis, Practical Approaches Using cluster Computing", IPTC 10751, Nov. 2005.*

* cited by examiner

METHOD, SYSTEM AND PROGRAM STORAGE DEVICE FOR HISTORY MATCHING AND FORECASTING OF HYDROCARBON-BEARING RESERVOIRS UTILIZING PROXIES FOR LIKELIHOOD FUNCTIONS

RELATED APPLICATION

This nonprovisional application claims the benefit of co-pending, provisional patent application U.S. Ser. No. 60/882,471, filed on Dec. 28, 2006, which is hereby incorporated by reference in its entirety.

TECHNICAL FIELD

The present invention relates generally to methods and systems for reservoir simulation and history matching, and more particularly, to methods and systems for calibrating reservoir models to conduct forecasts of future production from the reservoir models.

BACKGROUND OF THE INVENTION

One way to predict the flow performance of subsurface oil and gas reservoirs is to solve differential equations corresponding to the physical laws that govern the movement of fluids in the subsurface. Because of the nature of the problem, the differential equations are conventionally solved using numerical methods working in discrete representations in space and time. Solving such equations typically requires the use of three dimensional, discrete representations of the subsurface rock properties and the associated fluids in the rocks.

In the oil and gas industry, numerical methods to solve for the flow of fluids in the reservoir are called "Numerical Reservoir Simulation", or simply "Flow Simulation". Predictions of future performance of subsurface oil and gas reservoirs with models based on physical laws are considered the highest standard in current technology. The three dimensional, discrete models of the subsurface are constructed in such a way that the models are consistent with actual measurements taken from the reservoir. Some of these measurements can be included directly in the model at the time of the construction. Other measurements, such as ones that are related to the movement of fluids within the reservoir, are used in an indirect manner utilizing a model calibration process. The calibration process involves assigning properties to the model and then verifying that the solutions computed with a numerical reservoir simulator are consistent with the measurements of the fluids. This calibration process is iterative and stops when the reservoir model is able to replicate the observations within a predetermined tolerance. Once the model is appropriately calibrated, the model can be run in a flow simulator to forecast or predict future performance.

The process of calibrating numerical models of oil and gas reservoirs to measurements related to production and/or injection of fluids is usually referred to as history matching. The calibration problem described previously may be considered as being a particular case within the field of inverse problem theory in mathematics. While there exists a rigorous mathematical framework for the solution of model calibration problems, such a framework becomes impractical for dealing with complex problems such as large scale reservoir flow simulation. For a detailed explanation of such a framework, see A. Tarantola, *Inverse Problem Theory—Methods for Data Fitting and Model Parameter Estimation*, Elsevier, 1987, hereinafter referred to as "Tarantola". This Tarantola reference is hereby incorporated by reference in its entirety into this specification.

There are numerous difficulties in calibrating numerical models of oil and gas reservoirs to data related to the movement of fluids within the reservoirs. First, numerical models based on laws of physics are usually complex and a significant amount of computational time is required to evaluate, i.e. run a simulation on, each numerical model. Data to calibrate the numerical models are often uncertain. Furthermore, data to calibrate numerical models are scarce, both in time and space dimensions. Finally, there is not a unique solution to the calibration problem. Rather, there are many ways to calibrate a numerical model that is still consistent with all the measurements. Thus, there is not a unique calibrated numerical model. Accordingly, a probability is associated with any combination of model parameters and this probability may be expressed such as by using a probability density function (PDF).

The mathematical inverse problem theory provides the framework to deal with the inverse problem presented by reservoir flow simulation. Tarantola describes the mathematical theory applicable to the problem of calibration and uncertainty estimation. The solution to the problem is based on application of techniques relying on Monte Carlo simulation. The general approach prescribed by the mathematical theory, as described by Tarantola, can be summarized with a high level of simplification as follows.

A parameterization system, comprising model parameters, is defined for a mathematical model. Initially, an "a priori" probabilistic description is defined for the model parameters describing the mathematical model. Next, a probabilistic model is defined for measured or observed data which is to be used for calibration. This probabilistic model is constructed by defining a measure of the discrepancy between actual observed measurements of parameters and corresponding calculated parameters predicted by using the mathematical model. This measure of discrepancy is associated with a "likelihood" function in a Bayesian approach to updating probabilities. Then an "a posteriori" probabilistic description of the model parameters is constructed by updating the "a priori" probabilistic model using the observed measurements. In the most general case, the model parameter space is sampled in such a way that the resulting probability density function provides the desired "a posteriori" probabilistic description of the model parameters. The sampling takes into account the "a priori" model description. A common approach for performing the sampling is the application of variants of the Metropolis algorithm for Monte Carlo sampling. This process also produces probability density functions that correspond to the predictions calculated with the reservoir model.

The step of sampling the model parameter space is the most computational demanding part of this process and limits the practical application of this rigorous mathematical approach to solving problems involving oil and gas reservoir models based on physical laws. Using terminology commonly associated with inverse problem theory, the process involves solving the "forward problem" (running the flow simulation) a very large number of times during the sampling of the parameter space. The "forward problem" refers to computing the model response to a given combination of input model parameters.

Tarantola describes the use of probability theory in inverse problems such as in history matching and production forecasting. Likelihood functions need to be computed in the applications described by Tarantola. A likelihood function is a measure of how good results from a simulation run on a proposed model are as compared to actual observed values. Computation of likelihood functions in conjunction with very large models, such as are used in reservoir simulations, are not practical due to great computational costs. Evaluation of a likelihood function requires a reservoir simulation run. Each run of a large reservoir simulation may require hours of time to complete. Furthermore, thousands of such simulations may be required to obtain valid results.

There is a need for a practical method for history matching and forecasting wherein the high computational costs associated with calculating likelihood functions are reduced to a manageable level. The present invention addresses this need.

SUMMARY OF THE INVENTION

A method, system and program storage device for history matching and forecasting of subterranean reservoirs is provided. Reservoir parameters and probability models associated with a reservoir model are defined. A likelihood function associated with observed data is also defined. A usable likelihood proxy for the likelihood function is constructed. Reservoir model parameters are sampled utilizing the usable proxy for the likelihood function and utilizing the probability models to determine a set of retained models. Forecasts are estimated for the retained models using a forecast proxy. Finally, computations are made on the parameters and forecasts associated with the retained models to obtain at least one of probability density functions, cumulative density functions and histograms for the reservoir model parameters and forecasts. The system carries out the above method and the program storage device carries instructions for carrying out the method.

It is an object of the present invention to substitute low computational cost, non-physics based likelihood proxies for likelihood functions while applying inverse problem theory to calibrate reservoir simulation models and to forecast production from such calibrated simulation models.

It is another object to create likelihood proxies for likelihood functions which are used in history matching of reservoir simulation models with actual production data.

It is yet another object to build a likelihood proxy for a likelihood function that optimizes the number of flow simulations required to achieve a predetermined level of accuracy in approximating the true likelihood function.

BRIEF DESCRIPTION OF THE DRAWINGS

These and other objects, features and advantages of the present invention will become better understood with regard to the following description, pending claims and accompanying drawings where:

DETAILED DESCRIPTION OF THE INVENTION

The present invention provides a method to calibrate numerical models of subsurface oil and gas reservoirs to measurements related directly and indirectly to the production and/or injection of fluids from and/or into the reservoirs. Further, the present invention provides a method for estimating the uncertainty associated with future performance of the oil and gas reservoirs after the calibration of the numerical models.

Probabilistic descriptions can be obtained which are conditional to observed data related to the movement of fluids within the subsurface, for both the mathematical models used to represent actual oil and gas reservoirs and for the predictions of future performance computed using such models. Both model description and predictions are ideally conveyed by way of approximated probability density functions (PDF's) conditioned to the observed data. The probabilistic description of both the reservoir model and predictions (forecasts) are of significant importance to decision processes related to reservoir production based on risk analysis.

Figure 1:
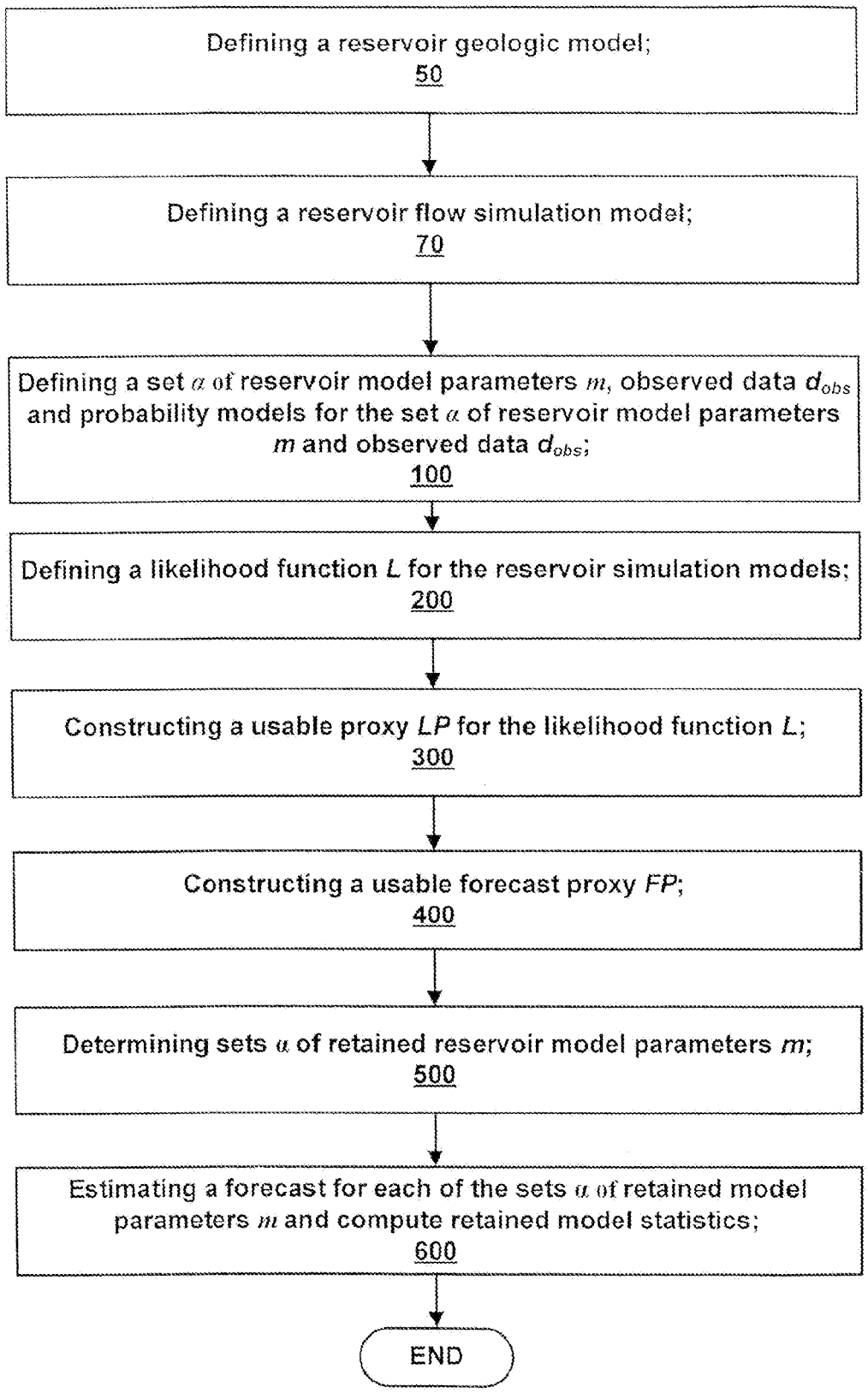
FIG. 1 is a flowchart of a preferred embodiment of a production forecasting method made in accordance with the present invention.

FIG. 1 is a flowchart of steps taken in a preferred embodiment of the present invention. High level steps will first be described. Then, these high level steps will be described in greater detail, often using other flow charts.

First, reservoir models, which include reservoir geologic models and reservoir flow simulation models, are defined in steps 50 and 70, respectively, for one or more subterranean reservoirs. Reservoir model parameters, i.e., a set or vector a of parameters $m_i$, characteristic of geologic and flow simulation properties, observed data $d_{obs}$ and probability models associated with the reservoir parameters $m_i$ and observed data $d_{obs}$ are defined in step 100. A likelihood function L is then defined for flow simulation models in step 200. A usable likelihood proxy LP is constructed in step 300 to approximate the likelihood function L. A usable forecast proxy FP is then constructed in step 400. Next, a sampling is performed in step 500 on sets $\alpha$ of reservoir parameters m to obtain a set of retained reservoir models. A forecast is estimated in step 600 for each of the retained reservoir models using the usable forecast proxy FP. Finally, statistics, such as probability density functions (PDF's), cumulative density functions (CDF's) and histograms, are computed for the forecasts and for the sets a of reservoir parameters m.

One or more geologic models are created in step 50 in a process generally referred to as reservoir characterization. These geologic models are ideally three-dimensional, discrete representations of subsurface formations or reservoirs of interest which contain hydrocarbons such as oil and/or gas. Of course, the present invention could also be used with 2-D or even 1-D reservoir models. Examples of data used in constricting a geological model may include, by way of example and not limitation, seismic imaging, geological interpretation, analogs from other reservoirs and outcrops, geostatistics, well cores, well logs, etc. Data related to the flow of fluids in the reservoirs are typically not used in the construction of the geological models. Or if this data is used, it is generally only used in a minor way.

Reservoir flow simulation models are created in step 70, generally one flow simulation model for each geologic model. These flow simulation models are to be run using a flow simulator program, such as Chears™, a proprietary software program of Chevron Corporation of San Ramon, Calif.

or Eclipse™, a software program publicly available from Schlumberger Corporation of Houston, Tex. Those skilled in the art will appreciate that the present invention may also be practiced using many other simulator programs as well. These simulator programs numerically solve differential equations governing the flow of fluids within subsurface reservoirs and in wells that fluidly connect one or more subsurface reservoirs with the surface. Inputs for the flow simulation model typically include three dimensional, discrete representations of rock properties. These rock properties are obtained either directly from the geological model defined in step 50 or else through a coarsening process, commonly referred to as "scale-up". Inputs for the flow simulation model typically also include the description of properties for fluids, the interaction between fluids and rocks (i.e. relative permeability, capillary pressure, etc), and boundary and initial conditions.

Reservoir models, i.e., vectors $\alpha$ of parameters m, observed data $d_{obs}$ and their associated probability models are defined in step 100. The reservoir model, which includes the geologic and flow simulation models, is parameterized with a vector a of reservoir model parameters m. A non-limiting exemplary list of reservoir model parameters m includes:

(a) geological, geophysical, geostatistical parameters and, more generally, the same input parameters for algorithms invoked in the workflow used to construct the geological and/or flow simulation models, i.e., water-oil contacts, gas oil contacts, structure, porosity, permeability, fault transmissibility, histograms of these properties, variograms of these properties, etc. The reservoir model parameters m can be defined at different scales. For example, some parameters may affect the reservoir model at the scale used to construct a geological model, and others can affect a flow simulation model which results from the process of coarsening (scale-up). The coarsening process produces the flow simulation model used for computation of movement of fluids within the subsurface reservoir. For an example of a reservoir model parameterization system at the level of a Geological Model, see Jorge Landa, *Technique to Integrate Production and Static Data in a Self-Consistent Way*, SPE 71597 (2001) and Jorge Landa and Sebastien Strebelle, (2002), *Sensitivity Analysis of Petrophysical Properties Spatial Distributions, and Floss Performance Forecasts to Geostatistical Parameters Using Derivative Coefficients*, SPE 77430, 2002;

(b) parameters related to the description of the fluids properties in the reservoir (i.e. viscosity, saturation pressure, etc), parameters affecting the interaction between reservoir rock and reservoir fluids (i.e., relative permeability, etc), and well properties such as skin, non-darcy effects, etc.

A first "a priori" probabilistic model is defined for the vector $\alpha$ of reservoir model parameters m defined above. This probabilistic model could be as simple as a table defining the maximum and minimum values that each of the parameters m may take, or as complex as a joint probability density function (PDF) for all the reservoir model parameters m. The a priori probabilistic model defines the state of knowledge about the vector $\alpha$ reservoir model parameters m before taking into consideration data related to the movement of fluids in the reservoir or reservoirs.

A second probabilistic model is defined for observed data $d_{obs}$. This observed data $d_{obs}$ will later be used to update the a priori probability reservoir model parameters m. The second probabilistic model for the observed data $d_{obs}$ ideally takes into consideration the errors in the measurements of the observed data $d_{obs}$ and the correlation between the measurements of the observed data $d_{obs}$. The second probabilistic model may also include effects related to limitations due to approximations to the true physical laws governing the reservoir model.

A typical example for the second probabilistic model for the observed data $d_{obs}$ is a multi-Gaussian model with a covariance matrix $C_d$. Of course, those skilled in the art of data analysis will appreciate that there are other possible data models which could be used as the second probabilistic model. In this preferred embodiment, the observed data $d_{obs}$ is data directly or indirectly related to the movement of fluids in the reservoir. Observed data $d_{obs}$, by way of example and not limitation, may include: flowing and static pressure at wells, oil, gas and water production and injection rates at wells, production/injection profiles at wells and 4D seismic among others.

A likelihood function L is defined in step 200 for the reservoir models. Eqns (1), and (2) below represent non-limiting examples of likelihood functions L:

$$L(\bar{\alpha}) = k\exp\left(-\frac{1}{2}\left(\bar{d}^{obs} - \bar{d}^{calc}\right)^T C_d^{-1}\left(\bar{d}^{obs} - \bar{d}^{calc}\right)\right) \tag{1}$$

or alternatively $$L(\bar{\alpha}) = k\exp\left(-\sum_{i=1}^{i=\text{n_data}} \frac{|d_i^{obs} - d_i^{calc}|}{\sigma_i}\right) \tag{2}$$

where

L=the likelihood function;

k=is a constant of proportionality;

$\vec{d}^{obs}$=observed data;

$\vec{d}^{calc}$=calculated data;

$C_d^{-1}$=inverse of covariance matrix of observed data;

n_data=number of observed data points;

$\sigma_i$=standard deviation for observation i; and i=index of data points in model parameter space.

For a more comprehensive list of approaches to define likelihood functions L, see Tarantola.

A likelihood proxy LP, preferably a "usable" likelihood proxy, for the likelihood function L is constructed in step 300. A "usable" likelihood proxy is a proxy that provides an approximation to the mathematically exact likelihood function L within a predetermined criterion.

Figure 2:
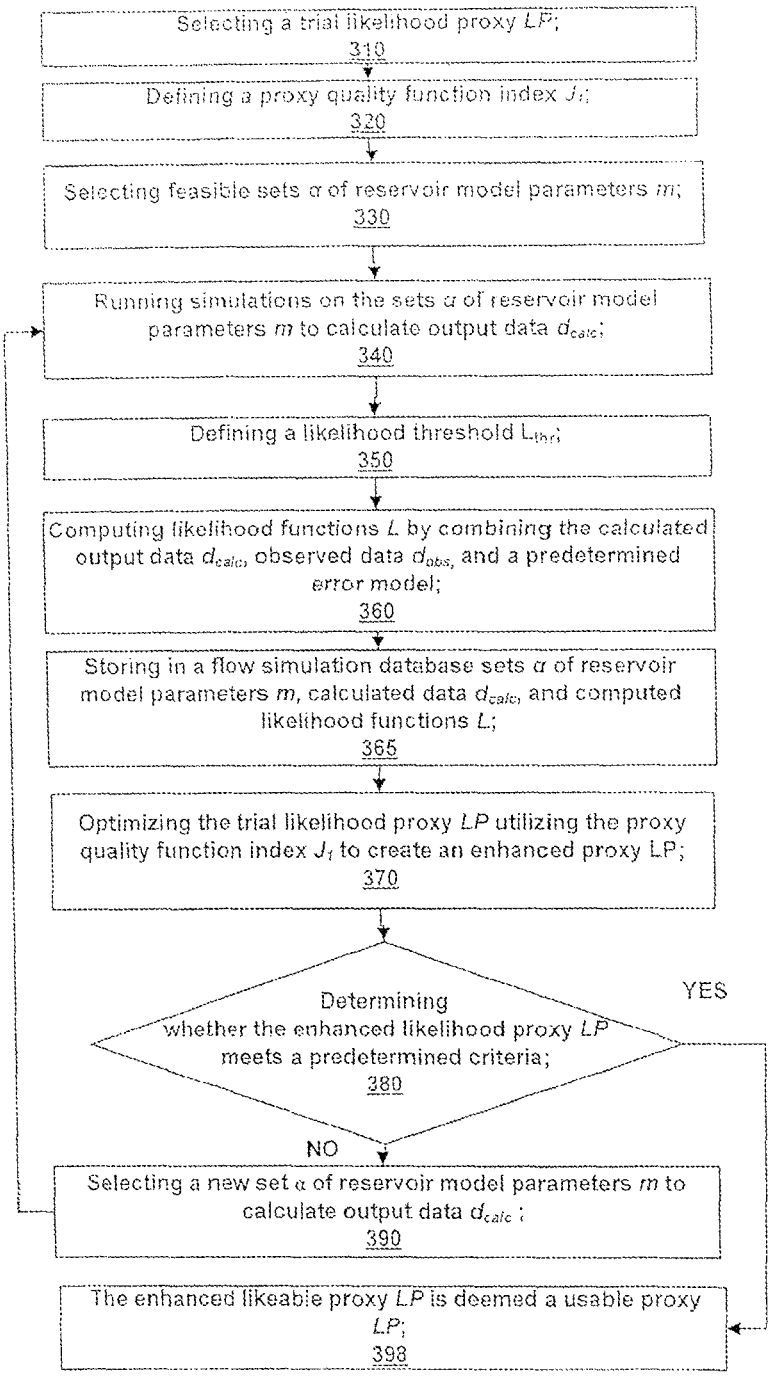
FIG. 2 is a flowchart of the construction of a usable likelihood proxy LP for a likelihood function L.

FIG. 2 is a flowchart describing exemplary steps comprising overall step 300. A trial likelihood proxy LP is selected in step 310. This trial likelihood proxy LP is ideally a low computational cost substitute for a computationally intensive model, such as is involved in computing an actual likelihood function L. The trial likelihood proxy LP need not be based on any physical laws. For example, it may be one of multi-dimensional data interpolation algorithms, such as kriging algorithms, which are commonly used in the field of geostatistics. In this exemplary embodiment, the preferred trial likelihood proxy LP for the estimation of the likelihood function L is a multi-dimensional data interpolator. The trial likelihood proxy LP uses, as part of its input, the reservoir model parameters m and produces an estimation of the likelihood function L that otherwise would practically have to be computed using a numerical flow simulator. Other non-limiting examples of trial likelihood proxies LP include other estimators such as, splines, Bezier curves, polynomials, etc.

A selected trial likelihood proxy LP may also require, as inputs, a secondary set of parameters β that can be used as tuning parameters. An approximation, P, to the likelihood function L, may be estimated as:

$$L(\alpha) \sim P = f(\alpha, \beta, s, \nu) \quad (3)$$

where f=trial likelihood proxy LP or the functional or algorithm to perform the estimation of L;

α=a vector of reservoir model parameters m characterizing a reservoir model;

s=a vector representing the locations in the reservoir model parameter space that has been previously sampled using a numerical flow simulator;

ν=a vector corresponding to the values of L at the previously sampled locations s; and β=additional input parameters for f.

For example, if f is a kriging interpolation algorithm, then a variogram is a parameter for f.

If the full or partial gradients of L, with respect to the model parameters β, ∇L or grad(L), are available, then the definition of the proxy f is adjusted to take advantage of the gradient information, i.e., P=f(α, s, ν, ∇β, β).

The likelihood proxy LP, which is a low computational cost substitute for L, can be constructed to model L directly or indirectly, as in the case of constructing proxies for a function of L, for example log (L); or proxies for $d_{calc}$ which are used as input in the definition of L (Eqns. 1 and 2).

A proxy quality function index $J_1$ is defined in step 320. This proxy quality function index $J_1$ is used to assess the quality of the output from the trial likelihood proxy LP relative to the output that would otherwise be obtained from a run of the numerical flow simulator. In this exemplary embodiment, a preferred mathematical form of the proxy quality function index $J_1$ may be expressed as:

$$J = (\Sigma(w_i * |L_i - P_i|^p)^{1/p}) \quad (4)$$

where $w_i$=weighting factor for the sample i;

$L_i$=mathematically exact likelihood function for the sample i;

$P_i$=estimated likelihood function for the sample i; and p=power (usually 1 or 2).

A first set of vectors α of reservoir model parameters m are selected in step 330. The reservoir models are constructed using reservoir model parameters m that are obtained from sampling the model parameter space within feasibility regions. Feasible models, located within the feasibility regions, are considered those which have a probability greater than zero in the a priori probability models. The sample locations are ideally determined using experimental design techniques. In this exemplary embodiment, the most preferred experimental design techniques are those which ensure that there is a good coverage of the sample space, such as using a uniform design sampling algorithm. Consequently, the sample vectors a are preferably more or less equidistantly distributed in the parameter space. Alternatively, sample locations might be determined using the experience of an expert practitioner. As a result of the above process, a geological model and a flow simulation model are obtained for each sample point.

Numerical flow simulations are run in step 340 on each of the flow simulation models constructed in step 330 to produce calculated data $d_{calc}$. This calculated data $d_{calc}$ is required to calculate the likelihood function L defined in step 200.

A likelihood threshold $L_{thr}$ is selected in step 350. The value of likelihood threshold $L_{thr}$ is selected in such away that models that result in L less than the threshold $L_{thr}$ are considered very unlikely models. The threshold $L_{thr}$ will be used to guide the construction of the likelihood proxy LP in a step 390, to be described below.

Likelihood functions L are computed in step 360 for the vector a of reservoir model parameters m of step 340 by combining the calculated data $d_{calc}$, $d_{obs}$, and the probability model for the observed data $d_{obs}$ defined in step 100. This computation utilizes Eqns. (1) or (2) of step 200. The results of the calculations are stored in step 365 in a flow simulation database which ideally stores (1) the vectors a of reservoir model parameters m used to create the flow simulation models, (2) the calculated data $d_{calc}$ and (3) the computed likelihood functions L.

An enhanced likelihood proxy LP is created in step 370 by optimizing the trial likelihood proxy LP utilizing the proxy quality function index $J_1$. This step includes searching for a secondary set of parameters β, of step 310, which results in a better proxy quality function $J_1$, of step 320. That is, the value of $J_1$ is minimized. In this exemplary embodiment, a preferred method of searching is based on gradients algorithms. Other non-limiting examples of applications might use commonly known optimizers, such as simulated annealing, genetic algorithms, polytopes, random search, trial and error.

The proxy quality function $J_1$ may be computed in several ways, depending on the particular type of trial likelihood proxy LP. For example, when using interpolation algorithms, such as kriging, there are numerous ways of calculating the proxy quality function index $J_1$. As a first example, the database may contain n different sample points, i.e., 1000 points. A first set of 700 points may be selected to build a trial likelihood proxy LP. Then, the remaining points, i.e., i=300 points, are used to make comparisons such as described in equation (4). In the most preferred embodiment, one point is extracted from the set of 1000 points and a trial likelihood proxy LP is created from the remaining 999 points. The estimation error of this extracted point is then computed for this likelihood proxy LP. This process of removing one point, calculating the proxy for the remaining points, and then calculating the error between that trial likelihood proxy LP and the extracted point is used to create the proxy quality function index $J_1$.

In step 380, the enhanced likelihood proxy LP of step 370 is evaluated as to whether it meets a predetermined criterion. For example, the predetermined criterion might be checking whether the enhanced likelihood proxy LP is within 10% of the true value which is produced from a simulation run associated with the tested location, i.e. space vector s. If the predetermined criterion is met, then the enhanced proxy is considered to be a "usable" proxy. If the predetermined criterion is not met, then additional samplings are needed to improve the quality of the likelihood proxy LP. In the event a predetermined number of simulations or a time limit is reached without arriving at a "usable" likelihood proxy LP, and if a large number of sets or vector a of reservoir parameters m have been identified that produce reasonable matches to the observed data $d_{obs}$, then the process is ended. These models a of reservoir parameters m are then used to estimate the range of variability of reservoir parameters and forecasts.

Figure 3:
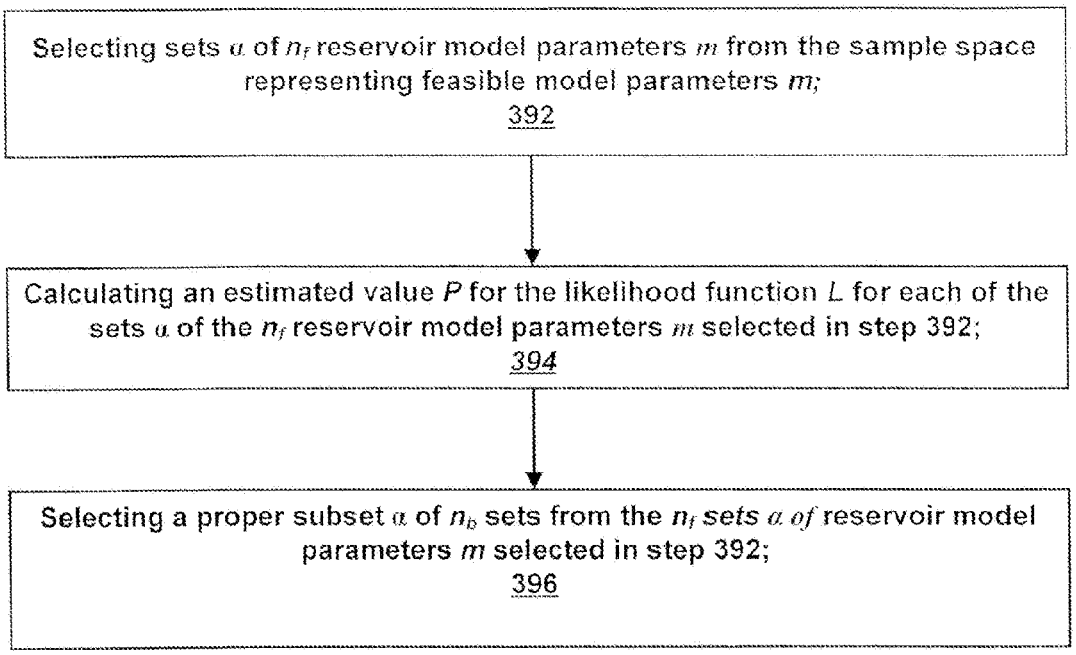
FIG. 3 is a flow chart describing steps in selecting sets or vectors a of model parameters m representative of reservoir models in constructing usable likelihood proxies LP.

In step 390, a new set or vector a of reservoir models is selected to generate new trial likelihood proxy LP candidates. Step 390 is further detailed out in steps 392-396. Referring now to FIG. 3, in step 392, a first set of $n_f$ reservoir models is selected using the following process. The parameter space is sampled at the $n_f$ locations using the enhanced likelihood proxy LP from step 370. In this process, the number $n_f$ of samples used is much greater than 1. This number $n_f$ is generally greater than 100, more preferably greater than 10,000, and most preferably will be on the order of a few million samples.

The process for obtaining the $n_f$ samples of locations is made in this example through the application of parallel or sequential sampling techniques such as experimental design, Monte Carlo, and/or deterministic search algorithms for finding locations in the parameter space that result in high values of estimated likelihood P. For example, the sampling technique could be random sampling, simulated annealing, uniform design, and/or gradient based optimization algorithms such as BFGS (Broyden, Fletcher, Golfarb and Shanno) formulation. Those skilled in art will appreciate that there are many other sampling techniques that will work with this invention. For example, see Tarantola and/or Philip E. Gill, Walter Murray, and Margaret H. Wright, *Practical Optimization*, Academic Press, (1992) for additional of these techniques.

The sampling may use one or a combination of several sampling and searching techniques. For example, if only one technique were used, then random sampling might be used. Or else, as a combination of techniques, random sampling, uniform design, random walks (such as Metropolis type algorithms) and gradient search algorithms might be used on each of a million sample points of the parameters to obtain the values of P for each of the sample points.

For each of the $n_f$ points selected, an estimated value of likelihood P is computed in step 394.

It is generally not computationally practical to run numerical flow simulations on all $n_f$ sample points. Therefore, in step 396 a proper subset of $n_b$ sample points is preferably selected from the $n_f$ sample points. The size of this proper subset $n_b$ is related to the available computational power to run numerical flow simulations. For example, assume $n_f$=1,000,000 and the proper subset $n_b$=100. Ideally, the 100 sample points are chosen to equidistantly sample the parameter space. Further, the region in the parameter space to be improved is the region or regions that provide high values of P. However, some samples are required in regions of the parameter space that are highly uncertain. This sampling is performed through a combination of "exploration" and "refining." "Exploration" refers to the sampling of regions of the parameter space with high uncertainty. "Refining" refers to the process of improving the quality of the proxy in regions that have already been identified as having high values of P. In the refining step, the selection is made such that the value of P is higher than the threshold value $L_{thr}$ determined in step 350. From this proper subset $n_b$. 100 sample points are selected which are generally equidistantly spaced, apart with respect to the previously locations that were sampled and used in flow simulations in step 340 and between the $n_b$ points. These $n_b$ points are used to create reservoir models to be processed in flow simulation in step 340.

Figure 4:
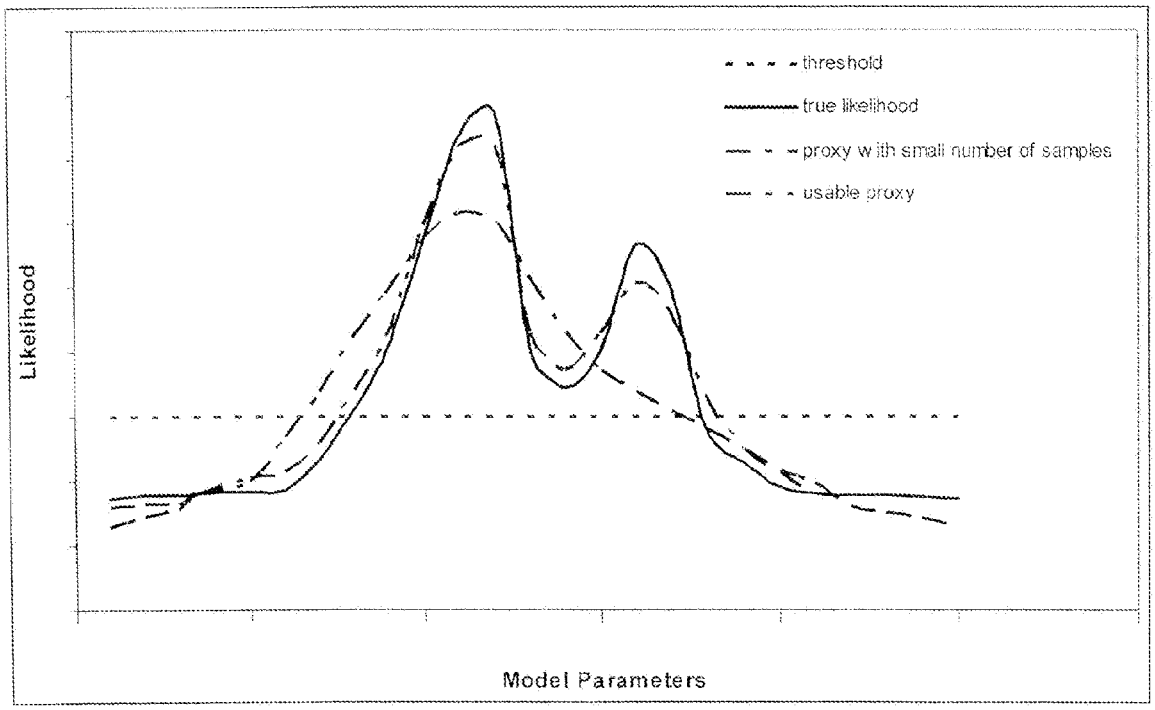
FIG. 4 is a graph depicting how a likelihood proxy LP is constructed for an associated likelihood function L.

FIG. 4 depicts the evolution of likelihood proxy LP during the process of step 300 in constructing a usable likelihood. For the sake of simplicity a graph of likelihood L versus a particular reservoir parameter m is shown. The likelihood threshold $L_{thr}$ is shown by a dotted line. The true likelihood function L is shown by a solid line. This true likelihood function L is equivalent to sampling with an infinite number of numerical flow simulations. The purpose of step 300 is to find a likelihood proxy (or substitute) that provides a good estimation of the true likelihood L at a significantly lower computational cost. A line-dot curve is used to represent the computed value P (the estimated value of L using a likelihood proxy LP) for the case of a small number of samples, at the earlier stages of process 300. This likelihood proxy LP does not generally provide a good approximation to L, and thus it is not generally usable proxy. A line-dot-dot curve represents a usable proxy LP, which provides a good approximation to L. This usable proxy LP is obtained after applying the process of taking addition samples during the refining and exploration stages in process 300.

Figure 5:
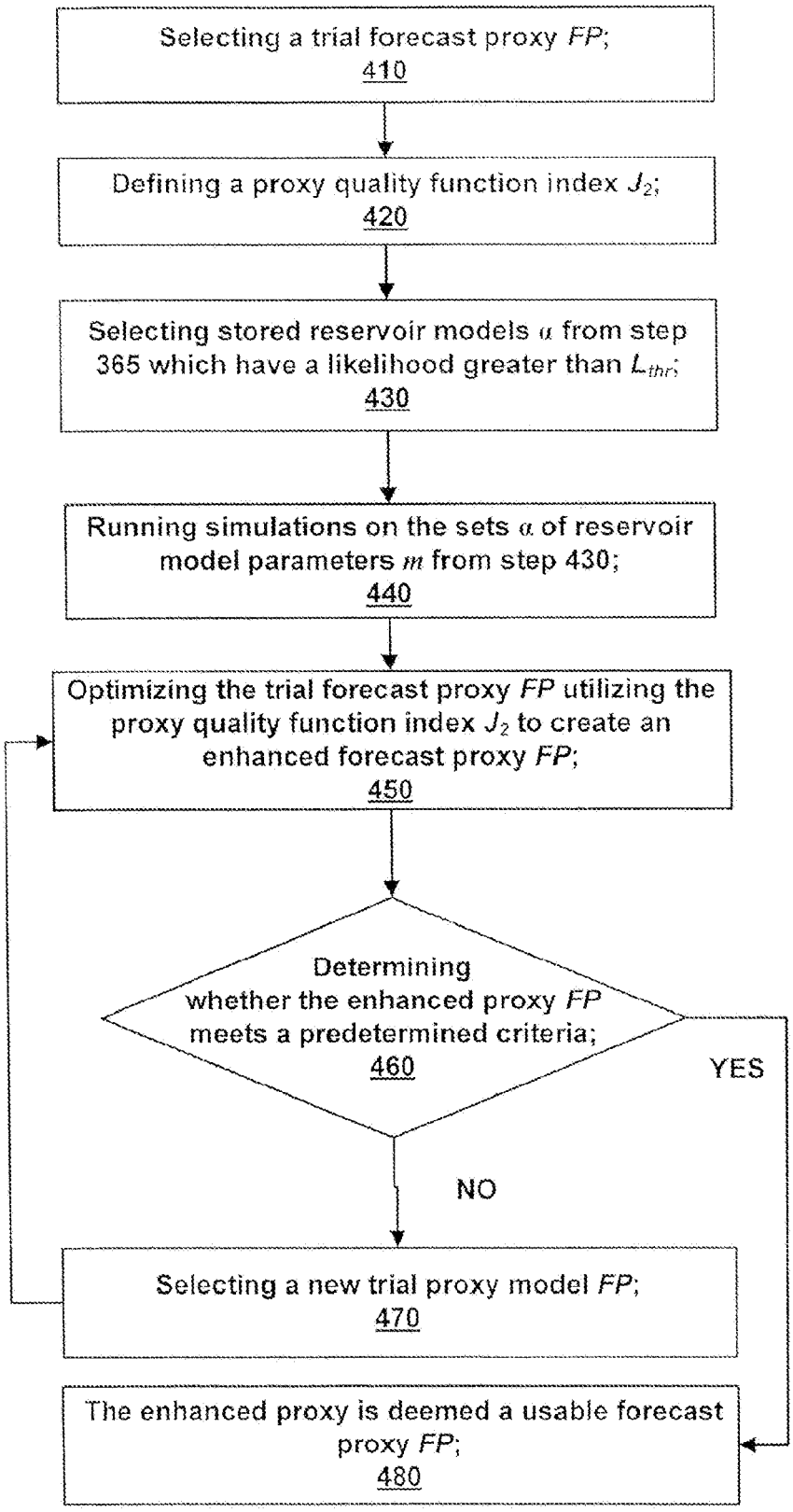
FIG. 5 is a flow chart describing steps taken in constructing a usable forecast proxy FP used to forecast results from selected reservoir models.

A usable forecast proxy FP is constructed in step 400. Referring now to FIG. 5, a trial forecast proxy FP is selected in step 410. A proxy quality function index $J_2$ is defined in step 420. The functional form for $J_2$ is similar to $J_1$ in Eqn. (4), but using forecasts instead of likelihood L. In step 430, reservoir model parameters are selected which were stored in step 365 and which have a likelihood L greater than a predetermined threshold, i.e, $L_{thr}$. In step 440, reservoir simulations are run on the models selected in step 430 to create output forecast data $d_{out}$. In step 450, the trial forecast proxy FP of step 410 is optimized using the tuning parameters β to produce an optimized quality proxy index $J_2$. In step 460, a determination is made as to whether the enhanced forecast proxy FP meets a predetermined criterion of usability. If the criterion is not met, then a new trial forecast proxy FP is selected in step 410 and steps 450-460 are repeated. If after many trials no useable forecast proxy FP is found, then additional simulations are needed. However, if the criterion is met, then the enhanced forecast proxy FP is deemed usable.

At this point, two usable proxies have been created. The LP proxy for the likelihood function LP has been created in step 300 and the forecast proxy FP has been created in step 400.

Reservoir model parameters are sampled in step 500 with Monte Carlo techniques utilizing the usable proxy LP for the likelihood function L, the forecast proxy FP, and utilizing the probability models to determine a set of retained models and their associated forecasts. In a preferred embodiment, the model parameter space is sampled using the well known *Metropolis* type algorithms that perform random walks in the reservoir model parameter space. Again, Tarantola can be consulted for a more detailed explanation.

Figure 6:
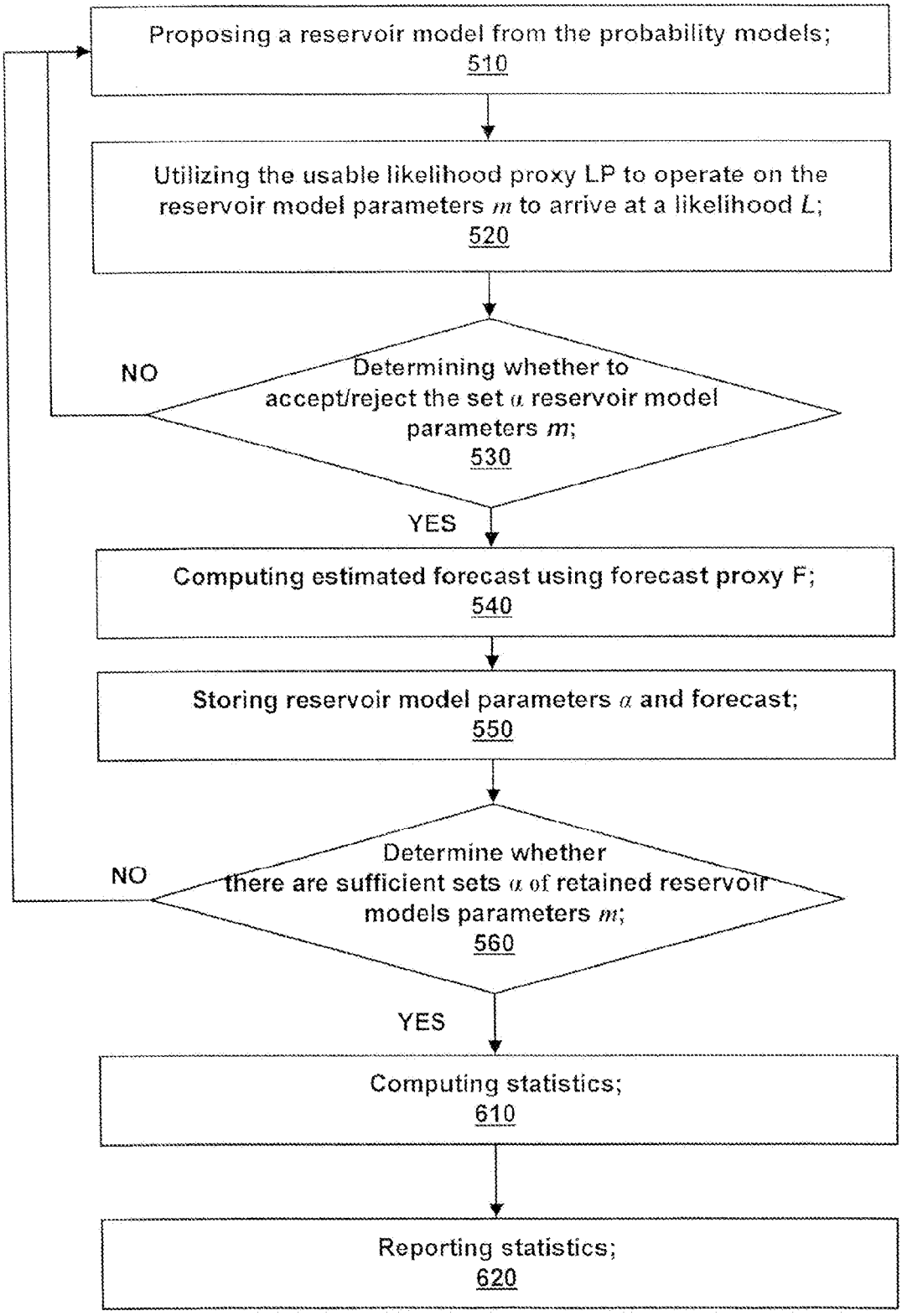
FIG. 6 is a flow chart describing the process for generating forecasts and associated statistics using a generic Monte Carlo sampling.

Referring now to FIG. 6, a reservoir model is proposed in step 510 from a random walk process that ensures the a priori probability models defined in step 100. In step 520, P, the estimated value for the likelihood function L, is computed using the usable likelihood proxy LP. The proposed model is tested based on an accept/reject basis in step 530. If the estimated likelihood P for the proposed model is higher or equal than the estimated likelihood P of the previously accepted model, then the proposed model is accepted. If that is not the case, that is the estimated likelihood P for the proposed model is lower than the estimated likelihood P of the previously accepted model, then the proposed model is accepted randomly with a probability $P_{proposed}/P_{last_accepted}$.

If the reservoir model parameters in is rejected, then this reservoir model is ignored and another reservoir model will again be proposed in step 510. If the reservoir model parameters are accepted, then an estimated forecast associated with the reservoir model parameters is computed in step 540 using the forecast proxy FP. The reservoir model parameters α and the associated forecast are stored for further use in step 550.

In step 560, a check is made to see if enough retained models have been accepted. If not, then another set a reservoir model parameter m is proposed in step 510. When sufficient retained models and their associated forecast have been determined and stored, statistics are computed in step 610. A first set of statistics can be generated for the sets α of reservoir model parameters m. This is commonly referred to as a "posterior probability" for the reservoir model parameters. A second set of statistics can be prepared for the forecast.

Ideally, these statistics are then displayed in step 620 in the form of a histogram, probability density function, probability cumulative density function (CDF), tables, etc.

Alternatively, by way of example and not limitation, step 500 could also be accomplished by direct application of Bayes Theorem (probability theory) using a large number of random sample points. See Eqn. (5) below:

$$p(\bar{\alpha} \mid d^{obs}) = \frac{p(\bar{\alpha})p(d^{obs} \mid \bar{\alpha})}{p(d^{obs})} = k_1 \frac{p(\bar{\alpha})L(\bar{\alpha})}{p(d^{obs})} \cong k_1 \frac{p(\bar{\alpha})P(\bar{\alpha})}{p(d^{obs})} = k_2 p(\bar{\alpha})P(\bar{\alpha}) \quad (5)$$

where $k_1$ and $k_2$ are proportionality constants, $p(\alpha|d^{obs})$ is the "posterior" probability of the reservoir model parameters (probability after adding the $d^{obs}$ information), $p(\alpha)$ is the "a priori" probability of the reservoir model parameters (probability before adding the $d_{obs}$ information); and P(a) is approximation to the Likelihood L computed using the usable proxy.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method for history matching and forecasting of subterranean reservoirs, the method comprising the steps of:

(a) defining reservoir parameters and probability models associated with a reservoir model;

(b) defining a likelihood function associated with observed data;

(c) constructing a likelihood proxy for the likelihood function, the likelihood proxy providing an approximation to the likelihood function within a predetermined criterion;

(d) sampling reservoir model parameters utilizing the likelihood proxy for the likelihood function and utilizing the probability models to determine a set of retained models;

(e) estimating a forecast for the retained models using a forecast proxy; and (f) computing at least one of probability density functions, cumulative density functions and histograms with the reservoir model parameters and forecasts associated with the retained models.

2. The method of claim 1 wherein the likelihood proxy constructed in step (c) is constructed to model the likelihood function indirectly.

3. A method for creating an acceptable likelihood proxy for a likelihood function, the method comprising:

(a) selecting a trial likelihood proxy for a likelihood function;

(b) defining a proxy quality function index J;

(c) selecting a first set of reservoir models from a sample space representing feasible models;

(d) running simulations on the first set of reservoir models to create calculated output data;

(e) computing likelihood functions L by combining the calculated output data, observed data and a predetermined error model;

(f) optimizing the trial likelihood proxy utilizing the proxy quality function index J to create an enhanced likelihood proxy;

(g) if the enhanced likelihood proxy meets a predetermined criterion, then defining the enhanced proxy as an acceptable likelihood proxy; else;

(h) selecting a new set of reservoir models from the sample space representing feasible models; and (i) repeating steps (d)-(h) using the new set of reservoir models until the enhanced likelihood proxy meets the predetermined criterion.

4. The method of claim 3 wherein step (h) further comprises: selecting a first proper subset of reservoir models from the sample space representing feasible models utilizing the enhanced likelihood proxy; and selecting a second proper subset of reservoir models from the first proper subset and all previously sampled reservoir models wherein the second proper subset of reservoir models are generally equidistantly located relative to each other within the sample space.

5. The method of claim 3 wherein the selecting the new set of reservoir models from the sample space in step (h) includes utilizing sampling techniques such that the selected reservoir models are generally equidistantly spaced from one another within the sample space.

6. The method of claim 3 wherein a gradient is used to construct the likelihood proxy for the likelihood function.

7. The method of claim 3 wherein no gradient is used to construct the likelihood proxy for the likelihood function.

8. A program storage device carrying instructions for history matching and forecasting of subterranean reservoirs, the instructions comprising:

(a) defining reservoir parameters and probability models associated with a reservoir model;

(b) defining a likelihood function associated with observed data;

(c) constructing a likelihood proxy for the likelihood function, the likelihood proxy providing an approximation to the likelihood function within a predetermined criterion;

(d) sampling reservoir model parameters utilizing the likelihood proxy for the likelihood function and utilizing the probability models to determine a set of retained models;

(e) estimating a forecast for the retained models using a forecast proxy; and (f) computing at least one of probability density functions, cumulative density functions and histograms with the reservoir model parameters and forecasts associated with the retained models.

9. A method for history matching of subterranean reservoirs, the method comprising the steps of:

(a) providing observed data from a subterranean reservoir and calculated data obtained using a plurality of reservoir models representative of the subterranean reservoir;

(b) defining a likelihood function responsive to the observed data and the calculated data;

(c) constructing a likelihood proxy representative of the likelihood function;

(d) utilizing the likelihood proxy to obtain a set of accepted reservoir model parameters, the accepted reservoir model parameters being associated with a likelihood greater than a predetermined threshold;

(e) constructing an optimized likelihood proxy utilizing the accepted reservoir model parameters;

(f) utilizing the optimized likelihood proxy to obtain retained reservoir model parameters; and (g) outputting the retained reservoir model parameters.

10. The method of claim 9 wherein the likelihood function defined in step (b) is defined responsive to a probabilistic model constructed for the calculated data.

11. The method of claim 9 wherein the likelihood function defined in step (b) is defined responsive to a probabilistic model constructed for the observed data.

12. The method of claim 9 wherein the likelihood proxy constructed in step (c) is a multi-dimensional data interpolator.

13. The method of claim 9 wherein the constructing the optimized likelihood proxy utilizing the accepted reservoir model parameters in step (e) includes using a proxy quality function index.

14. The method of claim 9 wherein the likelihood proxy constructed in step (c) provides an approximation to the likelihood function without performing simulation of the plurality of reservoir models.

15. The method of claim 9 wherein the optimized likelihood proxy constructed in step (e) provides an approximation to the likelihood function that is within a predetermined percentage of a value produced from a simulation run associated with locations in a reservoir model parameter space that have been previously sampled using a numerical flow simulator.

16. The method of claim 9 wherein utilizing the accepted reservoir model parameters in step (e) further comprises utilizing sampling techniques to select new reservoir models that are generally equidistantly spaced from one another within a sample space of the accepted reservoir model parameters.

17. The method of claim 9 further comprising:

(h) constructing a forecast proxy; and (i) optimizing the forecast proxy utilizing the accepted reservoir model parameters.

18. The method of claim 17 further comprising:

(j) using the optimized forecast proxy to forecast the performance of the subterranean reservoir.

19. The method of claim 9 wherein outputting the retained reservoir model parameters in step (g) comprises producing at least one of probability density functions, cumulative density functions, and histograms.

20. The method of claim 9 wherein outputting the retained reservoir model parameters in step (g) comprises displaying the retained reservoir model parameters.

21. The method of claim 9 wherein the constructing the optimized likelihood proxy utilizing the accepted reservoir model parameters in step (e) includes utilizing a proxy quality function index and utilizing sampling techniques to select new reservoir models that are generally equidistantly spaced from one another within a sample space of the accepted reservoir model parameters.

22. The method of claim 9 wherein the likelihood proxy constructed in step (c) is constructed to model the likelihood function indirectly.

* * * * *